United States Patent [19]

Cronin

[11] 4,104,620

[45] Aug. 1, 1978

[54] DUAL FILAMENT CURRENT LIMITING AND STATUS INDICATING CIRCUIT

[75] Inventor: Michael Joseph Cronin, Sherman Oaks, Calif.

[73] Assignee: Lockheed Aircraft Corporation, Burbank, Calif.

[21] Appl. No.: 755,558

[22] Filed: Dec. 30, 1976

[51] Int. Cl.[2] ..... G08B 21/00; H01J 7/42

[52] U.S. Cl. ..... 340/642; 315/69; 315/129; 340/644

[58] Field of Search ..... 315/69, 129, 291, 64, 315/312, 313, 130, 131, 132, 133; 340/248 R, 251, 46, 69, 282, 421; 200/310, 312

[56] References Cited

U.S. PATENT DOCUMENTS

| | | | |
|---|---|---|---|
| 1,256,691 | 2/1918 | Honsberger | 315/291 |
| 2,309,104 | 1/1943 | Dircksen et al. | 315/291 X |
| 2,934,752 | 4/1960 | Arrasmith | 200/317 X |
| 3,840,776 | 10/1974 | Takeda et al. | 315/69 |

FOREIGN PATENT DOCUMENTS

| | | | |
|---|---|---|---|
| 514,564 | 12/1930 | Fed. Rep. of Germany | 340/282 |

*Primary Examiner*—Alfred E. Smith
*Assistant Examiner*—Robert E. Wise
*Attorney, Agent, or Firm*—Ralph M. Flygare

[57] ABSTRACT

A status indicating and current limiting circuit includes a pair of lamp filaments connected in parallel to provide a high reliability for status indication of a monitored switch. The circuit indicates the status of the lamps as well as the open or closed status of the switch. In one embodiment, the pair of lamp filaments are serially connected in parallel between a source of current and the switch so that both the lamp filaments emit bright light when the switch is closed. The lamps are also connected to ground potential through a resistive element to maintain current flow through the lamp filaments when the switch is open, the current being at a level just below the current flow necessary to dimly light the filaments. In the event of a failure of one of the filaments, the other filament will begin to emit a dim but visible light even though the monitored switch is open indicating the failure of the one lamp filament. The lamp filaments may thus limit the current that will flow through the switch when the switch is closed, and indicate the status thereof since the lamp filaments are in a preheated condition as a result of the current flow through the resistive element, the resistance of the filaments to mechanical shock and vibration are improved, the surge current shock upon closure of the switch is reduced, and the switch contacts are relieved of high surge current. The longevity of the lamp filaments and the switch contacts is thus enhanced.

21 Claims, 8 Drawing Figures

DUAL FILAMENT CURRENT LIMITING AND STATUS INDICATING CIRCUIT

BACKGROUND OF THE INVENTION

The present invention relates generally to status indicating circuits and more particularly to status indicating and current limiting circuits for electrical switches in which lamps provide the status indication.

Single filament indicator lamps are commonly utilized in electrical circuits to indicate the status of electrical devices such as switches. For example, a single filament lamp oftentimes is provided in electrical equipment to indicate whether a power switch is open or closed. When the switch is closed, the indicator lamp emits visible light to indicate the status of the switch. When, however, the lamp is not lighted, it is not readily known whether the lamp is defective or whether the switch is open. Consequently, the use of press-to-test circuits has become common to predetermine the status-indicating feature of the indicator lamp. To determine the status of such lamps they may be tested individually or in groups. However, this testing merely indicates the condition of the lamps at the time of the test and does not provide a continuous monitoring of the condition of the filaments of the indicator lamps.

Ballast lamps may be utilized in electrical circuits to limit current flow. Such ballast lamps may be connected in series with other electrical devices to control current surges in a supply line in order to protect the other devices from being damaged by the current surge. However, if the lamp filament should become disabled, electrical current to the other electrical devices is generally interrupted. Furthermore, the use of ballast lamps does not provide a continuous monitoring of the condition of the lamp filament and frequent testing in a manner similar to the testing of indicator lamps is thus required.

It is accordingly an object of the present invention to provide a novel method and current limiting circuit in which the status of the current limiting device is continuously monitored.

It is another object of the present invention to provide a novel method and current limiting circuit in which two current limiting devices are connected in parallel to enhance the reliability for the circuit.

It is yet another object of the present invention to provide a novel method and status indication circuit in which the condition of the indicator lamp is continuously monitored.

Yet still another object of the present invention is to provide a novel method and circuit for both status indication and current limiting functions in which the longevity of the status indication lamps and the longevity of the contacts of the switch whose condition is being monitored are significantly increased.

These and many other objects and advantages of the present invention will be readily apparent to one skilled in the art to which the invention pertains from the claims and from the perusal of the following detailed description in connection with the appended drawings.

THE DRAWINGS

THE DETAILED DESCRIPTION

Figure 1:
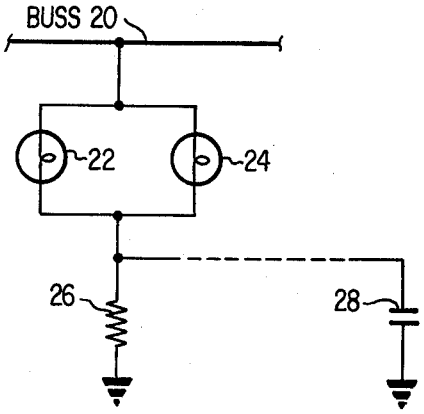
FIG. 1 is a schematic wiring diagram of an embodiment of the present invention including a pair of single filament indicator lamps as the current limiting devices.

Referring now to FIG. 1, the status indicating and current limiting circuit of the present invention includes the series connection to an electrical buss 20 of a pair of indicator lamps 22 and 24 connected in parallel, and a bleed resistor 26 and the normally open contacts 28 of a switch connected in parallel. The lamps 22 and 24 are selected as a function of the voltage supplied by the buss 20 so that the filaments of both of the lamps 22 and 24 become incandescent and emit bright, visible light when the switch 28 is closed to shunt the resistor 26. In this way, both of the lamps 22 and 24 indicate the open or closed status of the switch contacts 28. The filaments of the two lamps 22 and 24 also serve to limit the current that may flow through the switch contacts 28 upon closure of the switch.

The two lamps 22 and 24 are connected in parallel in the circuit to considerably increase the reliability of the circuit as an indication of the status of the switch contacts since the use of two lamps in parallel provides alternative paths for the electrical current to the switch in the event of the failure of one of the lamps. Thus the failure of one of the two lamps will not result in a loss of electrical current to the switch contacts 28 and the important information as to the status of the switch contacts.

The resistance value of the resistor 26 which parallels the switch contacts 28 is desirably selected so that the current flowing through the lamps 22 and 24 when the switch contacts 28 are open is not sufficient to cause the lamps to become incandescent and emit visible light. Preferably, the value of the resistance is selected so that the current flow is only slightly below the value of current flow necessary for the lamps to emit a dim, but visible, light.

By way of example and with continued reference to the embodiment of FIG. 1, the buss 20 may provide a low current supply of electricity at 28 volts D.C. At this voltage, the lamp filaments 22 and 24 may be selected to conduct approximately 0.02 amps each with the resistance of the resistor 26 selected somewhere between about 600 ohms and 700 ohms. Under these conditions, both of the lamp filaments will be kept warm by the continuous flow of current, but will not emit visible light until either the contacts 28 of the switch close or a fault such as a short circuit occurs. This continuous flow of current greatly improves the resistance of the filaments to shock and to vibration and thus considerably increases the life of the lamps. The preheating of the filaments also minimizes the surge of current through the switch contacts and thus enhances the life of the contacts. This limiting of current also serves to protect the load and power supply against voltage disturbances. The overall reliability of the circuit is thus considerably enhanced.

By maintaining the current through the lamps 22 and 24 at a value which is slightly below the value at which the lamps emit visible light, each of the lamps continuously monitor the condition of the other. In the event that one of the lamp filaments should fail while the switch contacts 28 are open, all of the current through the resistor 26 will pass through the other lamp filament effecting the emission of visible light to indicate the failure of the other lamp. The level of incandescence will be lower and distinguishable from the condition indicated by the closing of the switch contacts 28 by which the lamps are brought to full brilliancy.

If the switch contacts 28 close during the failure of one of the lamps 22 and 24, the current through the remaining lamp would be sufficient to bring the remaining lamp to full brilliancy and thus indicate the closed status of the switch contacts 28. The absence of any light from the disabled filament lamp under such conditions would, of course, indicate the failure of that particular lamp.

Figure 2:
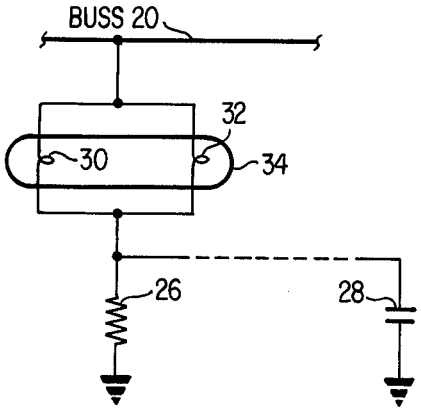
FIG. 2 is a schematic wiring diagram of a second embodiment of the present invention including a dual filament lamp.

With reference to FIG. 2 where like elements have been accorded like numerical designations, the status-indicating and current-limiting circuit of the present invention may include lamp filaments 30 and 32 enclosed within a single glass envelope 34. The use of a single envelope 34 may be more desirable than the use of individual lamps if a number of lamps are to be arranged on a control panel, as in, for example, a cockpit of an airplane to provide a remote status indication of limit switches actuated by landing gears, wing flaps, and so on. In such an environment, the switch being monitored may then comprise a lever-actuated microswitch which is mechanically operated by the particular device to close the normally open switch contacts 28.

Figure 3:
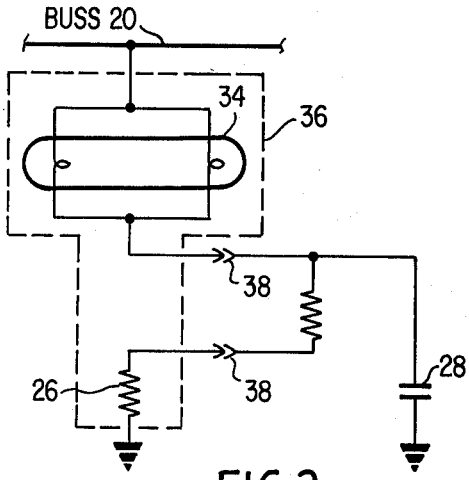
FIG. 3 is a schematic wiring diagram of an embodiment of the present invention in which the bleed resistive element and lamp are combined as a single unit.

To further facilitate use of the current-limiting and status-indicating circuit of the present invention in an aircraft control panel environment, the lamp and the bleed-resistive element may be combined as a single unit. As shown in FIG. 3, where like elements have again been accorded like numerical designations, the lamp 34 and the resistor 26 may be combined on a standardized support member 36 having suitable conventional quick-connect contact 38. The use of quick-connect contacts and a standardized support member for mounting the lamp and resistor not only facilitates changing the elements, but also prevents a possible mismatch of lamp and resistor value when a change in the rated voltage and current of the lamp is desired.

Figure 4:
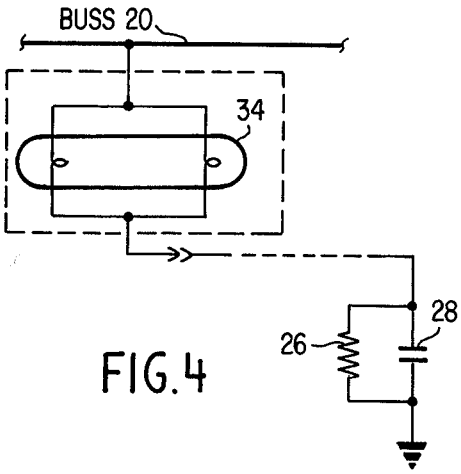
FIG. 4 is a schematic circuit diagram of an embodiment of the present invention in which the bleed resistive element is combined with the switch being monitored as a single unit.

An alternative to including the resistive element on a standardized support member is the combining of the resistive element with the contacts of the switch whose condition is being monitored. With reference to FIG. 4 where like elements have been accorded a like numerical designation, a particular advantage may exist in the inclusion of the resistor 26 within the body of the switch as a result of the heat dissipated by the resistor. For example, there are many mechanically actuated limit switches aboard an aircraft which are necessarily exposed to the atmosphere humidity and to extreme changes in temperature. A recurring problem with such switches used to detect the status of landing gear, etc., is that moisture may condense on the contacts, freeze, and effectively insulate the contacts. While the heat dissipated by the resistor 26 is not generally great, confining the resistor 26 and the switch contacts within a small cavity may obviate the problem.

Figure 5:
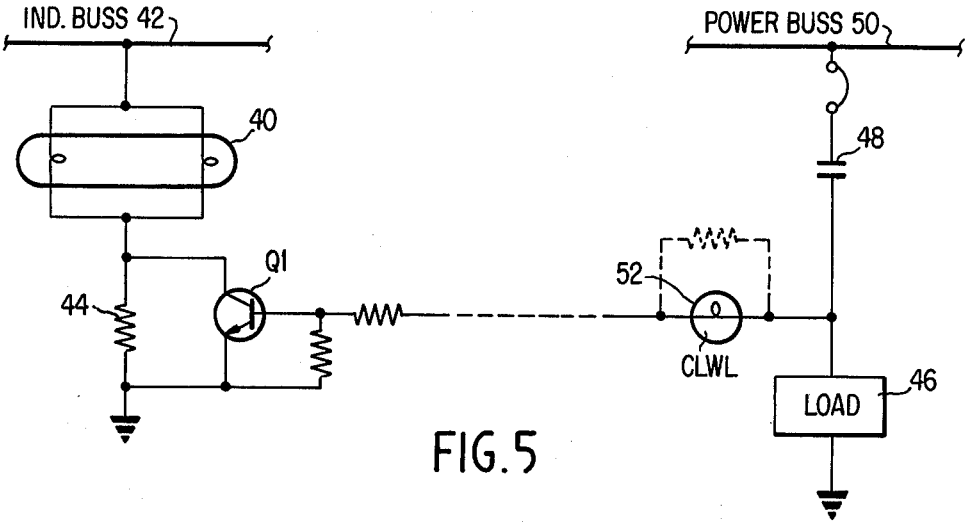
FIG. 5 is a schematic circuit diagram of an embodiment of the present invention for use when positive switching of the indicator lamp is desired in response to sensing current.

The current-limiting and status indicating circuit of the present invention may be used to indicate the status of a switch that is directly connected to the source of electrical current. In the circuit of FIG. 5, the warning lamp 40 is illustrated as having dual filaments connected in parallel between an indicator buss 42 and ground potential by way of a bleed-resistive element 44. The buss 42 may provide a low voltage, low current, D.C. supply of electricity, such as 28 volts D.C. Resistive elements 44 may be shunted by an electronic switch such as the illustrated NPN transistor Q1. When driven into conduction, the transistor Q1 will shunt the resistor 44 and thus increase the current through the indicator lamp 40 sufficiently to effect incandescence and the emission of bright, visible light to indicate the closure of the switch being monitored.

With continued reference to FIG. 5, a load 46 is shown connected to a power buss 50 through a pair of normally open switch contacts 48, the condition of which is being monitored. A current-limiting warning light (CLWL) 52 is connected between the control electrode of the transistor Q1 and a point 54 intermediate the load 46 and the switch contacts 48.

In the embodiment of FIG. 5, the indicator lamp 40 does not limit the current flowing through the switch contacts 48, but does serve to limit the current flowing through the transistor Q1 when it conducts responsively to the closure of the switch contacts 48. However, the two lamp filaments provide the same four-mode status indication for the switch contacts 48 and for the filaments of the lamp 40 as described in the previous embodiments. The lamp 40, the transistor Q1 and associated resistive elements and the bleed resistor 44 may all be provided on a standardized support member so as to be interchangeable in a suitably arranged console panel with other standardized support members as a function of the requirements of the particular circuit. Current limiting is, moreover, provided for overcurrent protection for the wiring between the CLWL 52 and the transistor Q1 by the CLWL 52 or a resistor shown in phantom.

Figure 6:
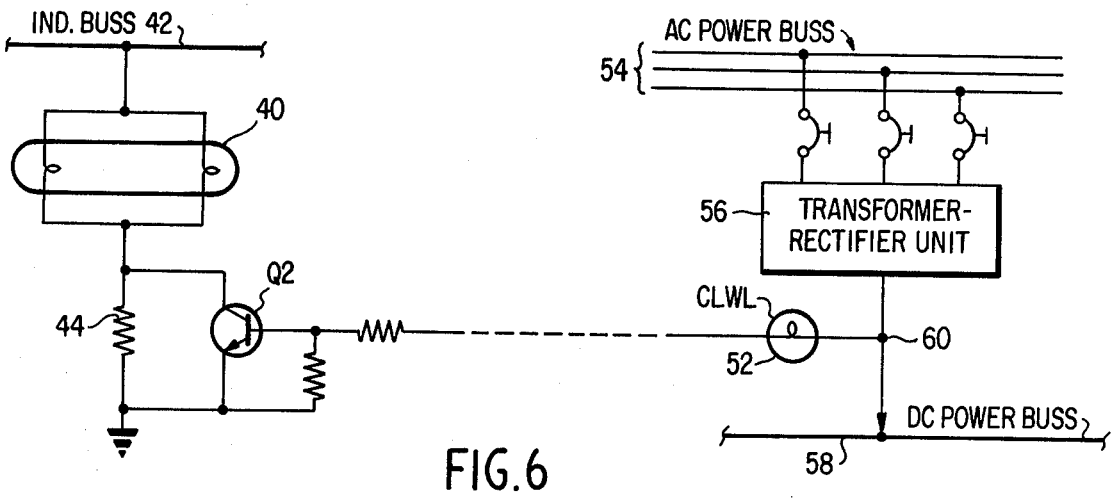
FIG. 6 is a schematic circuit diagram of an embodiment of the present invention for use when positive switching of the indicator lamp is desired in response to sensing voltage.

With reference to FIG. 6, where like elements have been accorded numerical designations consistent with those of FIG. 5, a three-phase A.C. power buss 54 is shown feeding a conventional transformer-rectifier unit 56 which in turn feeds a D.C. power buss 58. A point 60 intermediate the D.C. power buss 58 and the transformer-rectifier unit 56 is connected through a CLWL 52 to control the conduction of a NPN transistor Q2 which shunts the bleed resistor 44. In the circuit of FIG. 6, failure of the transformer-rectifier unit 56 will remove power from the D.C. power buss 58 and drive the transistor Q2 into cut off to eliminate the shunt of the resistor 44. The elimination of the shunting of the resistor 44 will, as earlier discussed, decrease the current flow through the lamp 40 sufficiently to eliminate incandescence and to indicate the loss of voltage.

Figure 7:
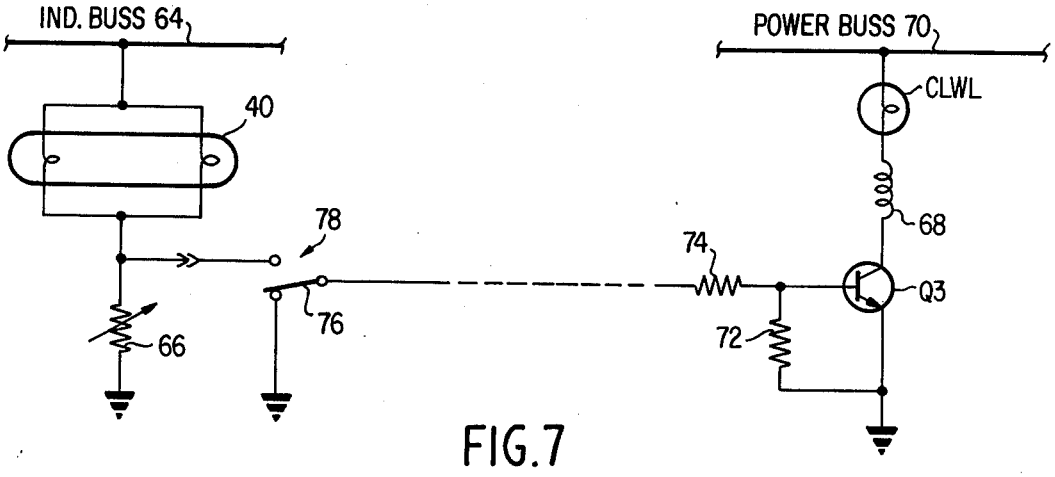
FIGS. 7 and 8 are schematic circuit diagrams of still other embodiments of the present invention.

With reference to FIG. 7, the filaments of the lamp 40 continuously monitor each other to indicate the failure of a lamp filament by emitting a dim but visible light from the functioning lamp filament. In addition, the circuit provides a fault-indicating or short-circuit-detection feature for faults occurring between the lamp filaments and the transistor Q3.

As shown in FIG. 7, a lamp 40 is connected between an indicator buss 64 and ground potential through a variable resistor 66. A load such as a relay coil 68 may be connected between a power buss 70 and the collector electrode of an electronic switch such as the illustrated grounded emitter NPN transistor Q3. The base electrode of the transistor Q3 is also connected to ground potential through a resistor 72, and through a resistor 74 to the arm 76 of a circuit control switch 78. The switch 78 may be a double throw switch having one contact connected to the interconnection of the lamp 40 and the ungrounded side of the variable resistor 66 and having the other contact connected to ground potential.

The value of the variable resistor 66 is desirably adjusted so that the current flowing through the filaments of the lamp 62 is just below the value of current flow necessary to cause the lamp to emit a dim but visible light when the switch 78 is open. It is a further advantage of the present invention that, when the filaments are enclosed in a lamp body having a transparent cover or lens, the legend on the lens may be readable in daylight and legibly visible with only normal current in a dark environment such as the dark adapted cockpit of an aircraft. As in the embodiments earlier described, the failure of one of the filaments of the lamp 40 will cause the other filament to emit a dim but visible light to indicate the failure of a lamp filament.

When the arm 76 of the switch 78 is connected to the lamp 40 so that current flows through the lamp filaments to the base electrode of the transistor Q3, current will flow through the voltage divider network of resistors 74 and 72 to control the conduction of the transistor Q3 which energizes the load 68. Since the input impedance of the transistor Q3 is high, the base to emitter electrode current is slight, the current through the filaments of the lamp 40 will not vary greatly. The variable resistor 66 may however be utilized to compensate for the effects of the remote impedance.

Figure 8:
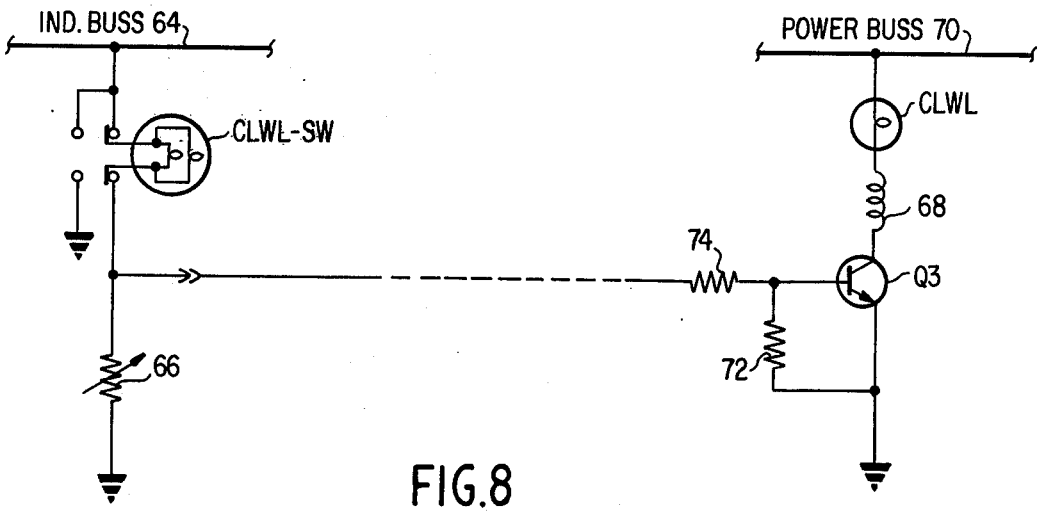

As described in the co-pending application, Ser. No. 755,657, entitled "Tungsten Lamp Circuit for Current Limiting and Fault Indication" filed concurrently herewith and hereby incorporated herein by reference, the operation of the switch 78 may be combined with a CLWL as illustrated in FIG. 8 to provide a current-limiting warning light switch (CLWL-SW). With reference to FIG. 8, it can be seen that depressing the CLWL-SW will ground the CLWL without effecting the operation thereof while simultaneously opening the circuit to the transistor Q3 in the load circuit from the power buss 70 depressing the CLWL-SW to remove power from the coltage divider network comprising resistors 74 and 72 will remove the normal forward bias of the transistor Q3 thereby deenergizing the normally powered load 68. Depressing the CLWL-SW will shunt the variable resistor 66 to bring the CLWL-SW to full brilliancy indicating the status of the transistor Q3 and thus the load 68.

The impedances in the lamp circuits, such as 26 in FIG. 1 and 44 in FIG. 5, may all be adjustable for purposes of calibration or the like even though they may not have been so shown or described hereinabove.

The present invention may thus be embodied in other specific forms without departing from the spirit or essential characteristics thereof. The presently disclosed embodiments are therefore to be considered in all respects as illustrative and not as restrictive, the scope of the invention being indicated by the appended claims rather than by the foregoing description, and all changes which come within the meaning and range of equivalency of the claims are therefore intended to be embraced therein.

What is claimed is:

1. An electrical circuit comprising:

first and second terminals;

lamp means connected to said first terminal, said lamp means including a plurality of filaments connected in parallel;

switch means connected between said lamp means and said second terminal; and, impedance means connected in parallel with said switch means between said lamp means and said second terminal, said impedance means having a value such that the current through the filaments of said lamp means when said switch means is open is insufficient to illuminate said lamp means, said value also being such that the same total current through less than all of the filaments of said lamp means due to the failure of one of said filaments is sufficient to illuminate said lamp means to a first illumination level with said switch means open whereby the status of said lamp means is indicated.

2. The electrical circuit of claim 1 wherein the value of said impedance means is also such that the current through the filaments of said lamp means is sufficient to illuminate said lamp means to a second level with said switch means closed to thereby indicate the closed position of said switch means.

3. The electrical circuit of claim 2 wherein said second level of illumination if higher than said first level of illumination to thereby distinguish between the closed position of said switch means and a faulty filament in said lamp means.

4. The electrical circuit of claim 3 wherein the value of said impedance means is also such that the current through any one of the filaments of said lamp means is sufficient to illuminate said lamp means to said second level of illumination to thereby indicate the closed position of said switch means even in the absence of a faulty filament in said lamp means.

5. The electrical circuit of claim 4 including a selectively removable support member; and, wherein said lamp means and said impedance means are carried by said support member for selective insertion into and removal from said circuit as a single unit.

6. The electrical circuit of claim 2 wherein said impedance means is selectively variable.

7. The electrical circuit of claim 1, including a selectively removable support member; and wherein said lamp means and said impedance means are carried by said support member for selective insertion into and removal from said circuit as a single unit.

8. The electrical circuit of claim 7 wherein said plurality of filaments are two and are enclosed within a single envelope.

9. The electrical circuit of claim 1, including a selectively removable support member; and, wherein said lamp means and said impedance means are carried by said support member for selective insertion into and removal from said circuit as a single unit.

10. The electrical circuit comprising:

first and second terminals;

lamp means connected to said first terminal, said lamp means including a plurality of filaments connected in parallel;

switch means connected between said lamp means and said second terminal; and, impedance means connected in parallel with said switch means between said lamp means and said second terminal, said impedance means having a value such that current through the filaments of said lamp means is insufficient to illuminate said lamp means with said switch means open but sufficient to illuminate said lamp means with said switch means closed, said filaments having sufficient impedance to limit the current through said switch means upon the closure of said switch means.

11. An electrical circuit comprising:

first and second terminals;

lamp means connected to said first terminal, said lamp means including a plurality of filaments connected in parallel;

impedance means connected to said second terminal and to said lamp means; and, switch means connected in parallel with said impedance means between said second terminal and said lamp means, said impedance means being variable between first and second values responsive to said switch means, the higher of said values being such that the current through all of the filaments of said lamp means is insufficient to illuminate said lamp means, the same total current through less than all of the filaments of said lamp means due to the failure of one of said filaments is sufficient to illuminate said lamp means to thereby indicate the status of said lamp means.

12. An electrical circuit of claim 11, including a selectively removable support member; and wherein said impedance means and said lamp means are carried by said support member as a single unit.

13. An electrical circuit of claim 11, wherein said impedance means includes a switch and an impedance element connected in parallel whereby the operation of said switch is effective to shunt at least a portion of said impedance element.

14. An electrical circuit of claim 13, including a selectively removable support member; and wherein said filaments are two in number and are enclosed in a single envelope.

15. An electrical circuit comprising:

first and second terminals;

lamp means connected to said first terminal, said lamp means including a plurality of filaments connected in parallel;

a first switch means connected between terminals;

a second switch means; and impedance means connected to lamp means, said second switch means being selectively operable to effect the operation of said first switch means, said impedance means having a value such that the current through the filaments of said lamp means with said second switch means open is insufficient to illuminate said lamp means, said value also being such that the current through less than all of the filaments of said lamp means due to failure of one of said filaments is sufficient to illuminate said lamp means to a first illumination level with said second switch means open whereby the status of said lamp means is indicated.

16. An electrical circuit of claim 15, wherein said impedance means is selectively variable.

17. An electrical circuit of claim 16, including a selectively removable support member; and wherein said filaments are two in number and are enclosed in a single envelope.

18. An electrical circuit comprising:

first and second terminals;

Lamp means connected to said first terminal, said lamp means including a plurality of filaments connected in parallel;

impedance means connected to said second terminal and said lamp means;

a third terminal;

first switch means having a control electrode;

load means;

first circuit means connecting said load means and said first switch means in series to said third terminal; and second circuit means including a second switch means for connecting the control electrode of said first switch means to a point intermediate said lamp means and said first terminal;

said impedance means having a value such that the current through all the filaments of said lamp means in series therewith is insufficient to illuminate said lamp means but the current through less than all of the filaments of said lamp means due to failure of one of said filaments is sufficient to illuminate said lamp means to a first illumination level whereby the status of said lamp means is indicated.

19. The electrical circuit of claim 18, wherein said second switch means is in series between (a) said point intermediate said lamp means and said impedance means and (b) the control electrode of said first switch means.

20. The electrical circuit of claim 19, wherein said impedance means is selectively variable.

21. An electrical indicator circuit for indicating both the status of a switch and the status of the indicator comprising:

a first terminal;

lamp means including a plurality of filaments connected in parallel to said first terminal;

a second terminal;

a switch connected between said second terminal and said lamp means;

impedance means connected between said second terminal and said lamp means;

the value of said impedance means such that, with said switch means open and said plurality of filaments operative, the current through said lamp means is insufficient to illuminate said lamp means;

the value of said impedance means being also such that, with said switch means open and less than all of said plurality of filaments operative, the current through an operative filament is sufficient to illuminate said lamp means to a first illumination level; and the value of said impedance means being also such that, with said switch means closed and any one of said plurality of filaments operative, the current through said lamp means is sufficient to illuminate said lamp means to a second illumination level greater than said first illumination level.

* * * * *